US010198932B2

(12) United States Patent
Ledingham et al.

(10) Patent No.: US 10,198,932 B2
(45) Date of Patent: Feb. 5, 2019

(54) WEARING COMPLIANCE OF PERSONAL EMERGENCY RESPONSE SYSTEM HELP BUTTON

(71) Applicant: KONINKLIJKE PHILIPS N.V., Eindhoven (NL)

(72) Inventors: Stephen Ledingham, Waltham, MA (US); Warner Rudolph Theophile Ten Kate, Waalre (NL); Michael Bellomo, Cambridge, MA (US); Andrea Ryter, Sharon, MA (US); Tine Smits, Beerse (BE)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 15/747,965

(22) PCT Filed: Jul. 5, 2016

(86) PCT No.: PCT/IB2016/054010
§ 371 (c)(1),
(2) Date: Jan. 26, 2018

(87) PCT Pub. No.: WO2017/017547
PCT Pub. Date: Feb. 2, 2017

(65) Prior Publication Data

US 2018/0225954 A1 Aug. 9, 2018

Related U.S. Application Data

(60) Provisional application No. 62/197,800, filed on Jul. 28, 2015, provisional application No. 62/272,131, filed on Dec. 29, 2015.

(51) Int. Cl.

| | |
|---|---|
| ***G08B 1/08*** | (2006.01) |
| ***G08B 25/01*** | (2006.01) |
| *G08B 21/02* | (2006.01) |

(52) U.S. Cl.
CPC ..... *G08B 25/016* (2013.01); *G08B 21/0286* (2013.01)

(58) Field of Classification Search
CPC .. G08B 25/016; G08B 21/0446; G08B 21/02; G08B 21/043; G08B 21/0286;
(Continued)

(56) References Cited

U.S. PATENT DOCUMENTS

2005/0212760 A1 9/2005 Marvit et al.
2007/0218866 A1 * 9/2007 MacIver ..... G08B 25/016 455/404.1

(Continued)

FOREIGN PATENT DOCUMENTS

WO 2012080964 A1 6/2012

OTHER PUBLICATIONS

Philips Research Europe: "Monitoring Wearing Compliance of Emergency Help Button"; Technical Note PR-TN 2014/00283, Jun. 2014, 14 Page Document.

(Continued)

*Primary Examiner* — Anh V La

(57) ABSTRACT

In a personal emergency response system (PERS), a personal help button (PHB) (10) includes a call button (12), a motion sensor (22), and a transmitter or transceiver (24) for transmitting a wireless call signal responsive to pressing the call button. An electronic processor (28) performs a compliance monitoring process (42) at successive compliance check times, each including: acquiring motion sensor data over a compliance data acquisition time interval; determining whether the PHB has moved since the last compliance check time; and assessing compliance based at least in part on the determination of whether the PHB has moved. The determining may include determining an orientation change of the PHB since the last check time. Alternatively, com- (Continued)

pliance may be monitored by detecting and logging wake-up interrupt events that cause the motion sensor to switch from a low-power mode to an operational mode.

12 Claims, 3 Drawing Sheets

(58) Field of Classification Search
CPC ..... G08B 21/0415; A61B 5/1117; A61B 5/02438; A61B 2503/08
USPC ... 340/539.11, 539.13, 539.12, 573.1, 573.4, 340/573.7
See application file for complete search history.

(56) References Cited

U.S. PATENT DOCUMENTS

2009/0160643 A1 6/2009 Lizza
2011/0045795 A1 2/2011 Sacknoff
2013/0090083 A1 4/2013 DeMont et al.
2014/0091934 A1* 4/2014 Vallance ..... G08B 21/0446 340/573.1
2014/0171152 A1* 6/2014 Dempsey ..... H04M 1/72536 455/564
2014/0316792 A1* 10/2014 Siddiqui ..... G06F 19/3418 705/2
2016/0055739 A1* 2/2016 Larson ..... G08B 21/24 340/539.13

OTHER PUBLICATIONS

Bai et al: "Design and Implementation of Fall Detecton and Voice Response Detection in a Smart Phone"; IEEE, 2014, 5 Page Document.
Medrano et al: "Personalizable Smartphone Application for Detecting Falls"; IEEE, 2014, pp. 169-172.
Tsai et al: Gesture-Aware Fall Detection System: Design and Implementation; IEEE 5th International Conference on Consumer Electronics Berlin, 2015, pp. 88-92.

* cited by examiner

WEARING COMPLIANCE OF PERSONAL EMERGENCY RESPONSE SYSTEM HELP BUTTON

CROSS-REFERENCE TO PRIOR APPLICATIONS

This application is the U.S. National Phase application under 35 U.S.C. § 371 of International Application No. PCT/IB2016/054010, filed on Jul. 5, 2016, which claims the benefit of U.S. Provisional Patent Application No. 62/197,800 filed on Jul. 28, 2015 and U.S. Provisional Patent Application 62/272,131, filed on Dec. 29, 2015. These applications are hereby incorporated by reference in their entirety herein.

FIELD

The following relates generally to the Personal Emergency Response System (PERS) arts and related arts.

BACKGROUND

A Personal Emergency Response System (PERS) enables an elderly person, handicapped person, or other person at elevated risk of accident or incapacitating medical emergency to summon help. As such systems are typically on a subscriber basis, i.e. the at-risk person subscribes to the PERS service (either on a paid basis, or with the subscription provided by a healthcare provider, governmental agency, or other sponsor). The PERS typically includes a personal help button (PHB) worn as a necklace-born pendant, or on a bracelet, or the like. By pressing the call button of the PHB, a speakerphone console in the residence is activated, by which the subscriber is placed into telephonic contact with a PERS agent. In another embodiment, a speaker is built into the PHB which communicates via a cellular connection or the like. The agent speaks with the subscriber and takes appropriate action such as talking the subscriber through the problem, summoning emergency medical service (EMS), or alerting a neighbor or other authorized person to check on the subscriber.

The PERS approach relies upon the subscriber actually wearing the PHB. Failure to comply with the instruction to wear the PHB can arise intentionally, for example if the subscriber finds wearing the PHB to be inconvenient, or accidentally due to forgetting to put the PHB on. Accidental failure to wear the PHB can be particularly likely in the case of a subscriber with a mental or psychological condition that tends to lead to forgetfulness.

The following discloses a new and improved systems and methods that address the above referenced issues, and others.

SUMMARY

Monitoring of subscriber compliance with wearing the personal help button (PHB) of a Personal Emergency Response System (PERS) can be useful in numerous ways. Such monitoring can identify patients with poor compliance for remedial training or other remedial action such as providing a more comfortable PHB form factor (e.g. a necklace rather than a wristband, or vice versa), and/or may be given to the subscriber's caregiver as part of a monthly report. In some embodiments, a non-compliant subscriber may be directly reminded to wear the PHB if this is feasible in spite of the noncompliance. Compliance information can also be useful in assessing impact of the PERS program, and/or for demonstrating a PERS failure was due to non-compliance rather than to a failure of PERS hardware or communications.

In embodiments disclosed herein, an accelerometer, magnetometer, or other motion sensor incorporated into the PHB is used to monitor subscriber compliance with wearing the PHB. In embodiments disclosed herein, compliance monitoring is achieved with reduced impact on battery life by acquiring motion sensor data from the motion sensor of the PHB over a compliance data acquisition time interval that is shorter than a time interval between successive compliance check times. For example, the compliance data acquisition time interval may be one minute or less, while compliance time checks may be performed every ten minutes, or every fifteen minutes, or every hour, or so forth. In other disclosed approaches, a wake-up interrupt event that causes the motion sensor to switch from a low-power mode to an operational mode is detected and logged in a wake-up event log. A compliance report assessing compliance with wearing the wearable personal help button can then be generated using the wake-up event log.

In one disclosed aspect, a device is disclosed for use in conjunction with a personal emergency response system (PERS). The device comprises: a wearable personal help button including a call button, a motion sensor, and a transmitter or transceiver configured to transmit a wireless call signal in response to the call button being pressed; and an electronic processor programmed to perform a compliance monitoring process using the motion sensor to assess compliance with wearing the wearable personal help button. In some embodiments, the compliance monitoring process is performed at successive compliance check times and includes, at each compliance check time: acquiring motion sensor data from the motion sensor of the wearable personal help button over a compliance data acquisition time interval shorter than the time interval between successive compliance check times; determining from the motion sensor data acquired over the compliance data acquisition time interval whether the wearable personal help button has moved since the last compliance check time; and assessing compliance with wearing the wearable personal help button based at least in part on the determination of whether the wearable personal help button has moved since the last compliance check time. The determining may include determining a current orientation of the wearable personal help button from the motion sensor data acquired over the compliance data acquisition time interval, and determining the wearable personal help button has moved since the last compliance check time if a difference between the current orientation of the wearable personal help button and the orientation of the wearable personal help button determined for the last compliance check time exceeds a threshold difference.

In other embodiments, the compliance monitoring process includes: detecting a wake-up interrupt event that causes the motion sensor to switch from a low-power mode to an operational mode; logging each detected wake-up interrupt event in a wake-up event log; and generating a compliance report assessing compliance with wearing the wearable personal help button using the wake-up event log.

In another disclosed aspect, a wearable health device comprises: a health monitoring component configured to acquire physiological data, acquire activity data, or generate a medical call signal; a motion sensor; and an electronic processor programmed to perform a compliance monitoring process using the motion sensor to assess compliance with wearing the wearable health device.

In another disclosed aspect, a method is performed in conjunction with a personal emergency response system (PERS). The method comprises: transmitting a wireless call signal in response to the pressing of a call button of a wearable personal help button; detecting the wireless call signal at a speakerphone console and establishing a telephone call via the speakerphone console in response to detecting the wireless call signal; and performing a compliance monitoring process using a motion sensor of the wearable personal help button to assess compliance with wearing the wearable personal help button.

One advantage resides in providing unobtrusive detection of non-compliance (that is, failure to wear the PHB).

Another advantage resides in providing detection of non-compliance with low power draw on the PHB and hence providing detection of non-compliance with reduced impact on PHB operating time between battery recharge operations.

Another advantage resides in providing a non-compliant subscriber with a reminder to wear the PHB.

Another advantage resides in providing compliance information for use in PERS administration or the like, including when the subscriber is stationary or nearly so, for example during sleep or when sitting on a couch.

A given embodiment may provide none, one, two, more, or all of the foregoing advantages, and/or may provide other advantages as will become apparent to one of ordinary skill in the art upon reading and understanding the present disclosure.

BRIEF DESCRIPTION OF THE DRAWINGS

The invention may take form in various components and arrangements of components, and in various steps and arrangements of steps. The drawings are only for purposes of illustrating the preferred embodiments and are not to be construed as limiting the invention.

DETAILED DESCRIPTION

In illustrative embodiments described herein, the at-risk person served by the illustrative Personal Emergency Response System (PERS) is referred to as a "subscriber". This recognizes that the at-risk person subscribes with the PERS service so that the subscriber's personal help button (PHB) and linked speakerphone console are associated with the service and appropriate subscriber data are stored at the PERS server and made available to a PERS agent handling a subscriber event. It is to be understood that the term "subscriber" has no further connotation—for example, any costs or fees associated with the subscription may be paid by the subscriber, or by a medical insurance company, or by a governmental agency, or by some other third party.

Figure 1:
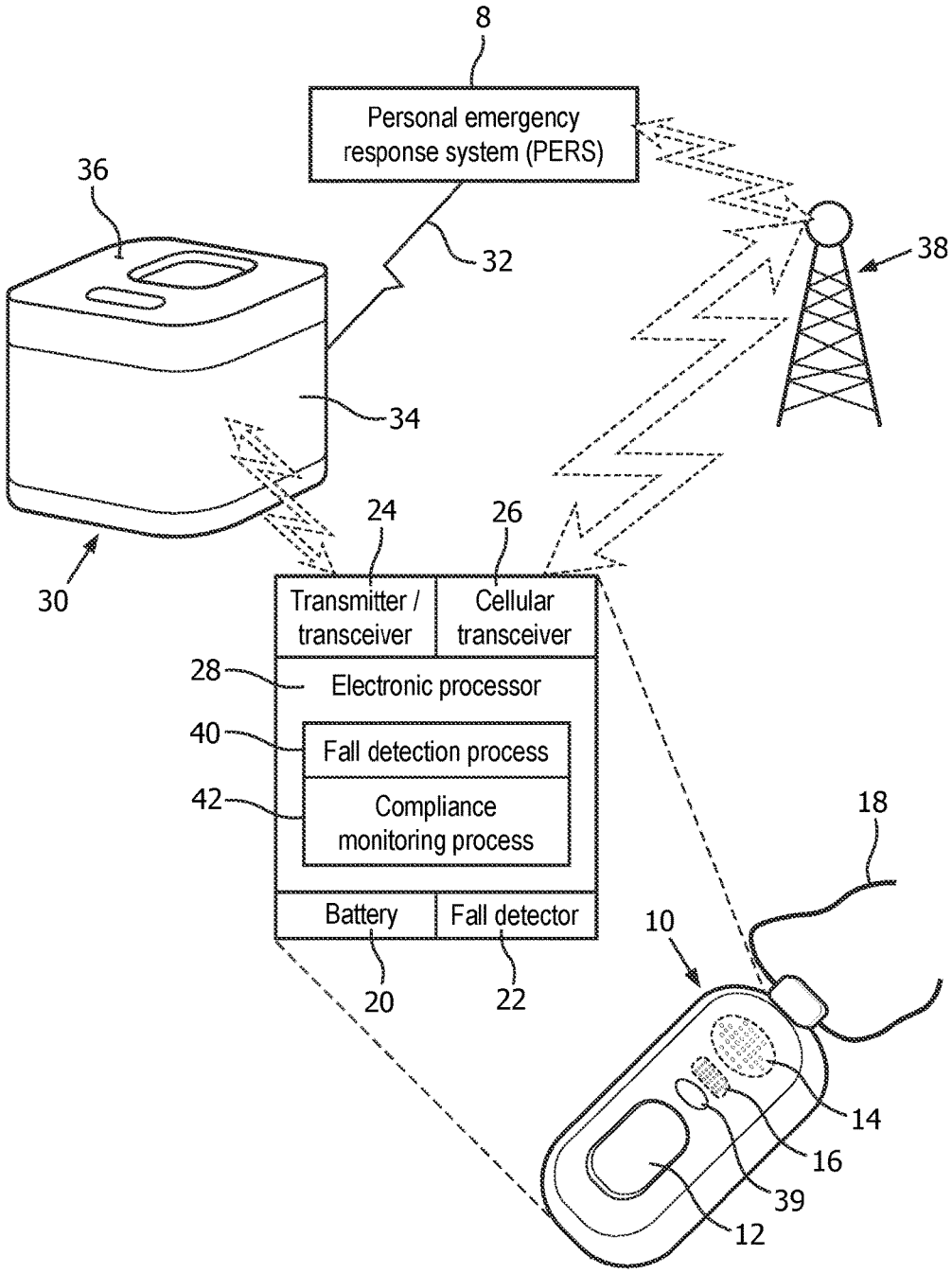
FIG. 1 diagrammatically illustrates a Personal Emergency Response System (PERS) employing a personal help button (PHB) with monitoring to detect non-compliance (that is, failure to wear the PHB).

With reference to FIG. 1, an illustrative Personal Emergency Response System (PERS) call center 8 is diagrammatically represented. The PERS call center 8 may include, by way of illustration, a call center staffed by PERS agents each having an electronic work station including a computer on which a subscriber's profile may be displayed and telecommunication equipment such as a headset via which the agent can converse with a subscriber. FIG. 1 also represents PERS equipment assigned to a representative subscriber, including a personal help button (PHB) 10 having a call button 12 for triggering a call to the PERS center 8, and optionally other features such as a built-in speaker 14 and microphone 16. The illustrative wearable PHB 10 is a pendant that is worn around the neck via a necklace 18 (shown in part). More generally, the wearable PHB is a unitary device that can have any suitable wearable form factor, such as the illustrative necklace-worn pendant, or a bracelet or wristband mount, or so forth, and includes simple and effective mechanism such as the illustrative push button 12 for triggering a call to the PERS call center 8. The wearable PHB 10 is suitably battery-powered by a built-in rechargeable and/or replaceable battery 20 to enable complete portability. The illustrative PHB 10 also includes a fall detector 22 comprising an accelerometer that triggers a call to the PERS call center 8 responsive to detecting a fall event (e.g. a rapid downward acceleration and/or abrupt termination of same, indicative of a sudden fall and/or hitting the ground). Additionally or alternatively, the fall detector 22 may comprise a magnetometer or other motion sensor capable of producing a sensor signal indicative of a fall event. The PHB 10 optionally has other attributes such as optionally being waterproof so it can be worn in a bath or shower. Because the PHB 10 is designed to be operated by the subscriber under duress possibly including compromised physical or mental agility, it is preferably designed to minimize operational complexity and likelihood of operator error. For example, in some embodiments the wearable personal button device 10 includes only the call button 12 and no other user controls, and the call button 12 is preferably large with a tactile surface to facilitate its activation by the subscriber even if the subscriber's hand is trembling or the subscriber has vision difficulty, pain, or is otherwise debilitated.

The PHB 10 further includes a transmitter or transceiver 24 for transmitting a wireless call signal to a speakerphone console 30. The transmitter or transceiver 24 may be a transmitter-only, or may be a transceiver enabling the PHB 10 to receive a signal—this can be useful, for example, in order to receive a transmission containing PHB configuration data from the speakerphone console 30. In some embodiments, the PHB 10 may also include a cellular transceiver 26 via which the subscriber can communicate when out-of-residence. The speakerphone console 30 is located in the residence and is connected with the PERS call center 8 via a reliable communication link 32 such as a telephone landline, i.e. telephone line 32, or a mobile/cellular or Voice Over Internet Protocol (VOIP). The transmitter or transceiver 24 has a range approximately coinciding with the spatial extent of the residence (and possibly its immediate environs, e.g. extending to encompass a neighboring house or an apartment floor above or below a residence apartment or so forth). Although the transmitter or transceiver 24 preferably provides coverage for the entire residence, it is contemplated that in some instances the short range communication may fail to provide such complete coverage and there may, for example, be one or two rooms of a large house that are not covered by the local wireless link 20. The speakerphone console 30 includes a speaker 34 and a microphone 36.

In operation, the subscriber presses the call button 12 on the PHB 10 to initiate a call to the PERS call center 8, for example in response to the subscriber experiencing a medical difficulty or otherwise needing assistance. Pressing the call button 12 triggers the transmitter or transceiver 24 to transmit a call signal to the speakerphone console 30, which automatically dials an appropriate telephone number to place a telephone call to the PERS center 8, where a PERS agent receives the call and speaks with the subscriber via the speakerphone capability of the speakerphone console 30 (that is, via the speaker 34 and a microphone 36). Alternatively, the speakerphone 30 may send a signal to the PERS call center 8 via the landline 32 which informs the PERS agent of the subscriber identification code (ID) of the subscriber, and the PERS agent looks up the telephone number assigned to the speakerphone 30 of the subscriber and telephones that number to initiate communication with the subscriber via the speakerphone console 30.

The speakerphone console 30 is limited to providing assistance to the subscriber when the subscriber is in-residence. Some embodiments are limited to this in-residence service, and the subscriber is unable to receive PERS assistance when away from the residence (or, more precisely, when the subscriber moves the transmitter or transceiver 24 out of range of the speakerphone console 30 and/or when the subscriber is too far away from the speakerphone 30 to engage in telephonic conversation using the speakerphone).

In other embodiments, the optional cellular transceiver 26 is provided to enable PERS coverage when the subscriber is out-of-residence. In a suitable approach, the transmitter or transceiver 24 is a transceiver 24 that enables the PHB 10 to receive confirmation feedback from the speakerphone console 30. For example, the transceiver 24 may poll the speakerphone console 30 every few minutes, and if no confirmation response is received from the speakerphone console 30 then the PHB 10 switches to a mobile mode using the cellular transceiver 26. When in mobile mode, pressing the call button 12 causes the cellular transceiver 26 to automatically dial the appropriate telephone number to place a telephone call to the PERS center 8, e.g. via a cellular tower 38 or other cellular link. A PERS agent receives the cellular call and speaks with the subscriber via a speakerphone capability built into the PHB 10, e.g. via the illustrative optional speaker 14 and microphone 16. Alternatively, the cellular transceiver 26 may send a signal to the PERS call center 8 via the cellular network (e.g. cell tower 38) which informs the PERS agent of the subscriber identification code (ID) of the subscriber and that the call is being issued via cellular, and the PERS agent looks up the cellular telephone number assigned to the PHB 10 of the subscriber and telephones that number to initiate communication with the subscriber via the optional speakerphone 14, 16 of the PHB 10.

The fall detector 22 can also initiate a PERS center call automatically following the above in-residence or out-of-residence process, but being initiated by a signal from the fall detector 22 rather than by activation of the call button 12. For example, when in-residence a detected fall causes the transmitter or transceiver 24 to transmit the same wireless call signal that is generated in response to pressing the call button 12.

To implement complex functionality such as fall detection, or performing call handling via the cellular transceiver 26 and speaker 14 and microphone 16, the illustrative PHB 10 includes the electronic processor 28 (e.g., a microprocessor or microcontroller) which is programmed to perform appropriate processes. As an illustrative example, the electronic processor 28 is programmed to perform an illustrative fall detection process 40 including analyzing motion sensor data acquired by the fall detector 22 (e.g. accelerometer) to detect a fall and, in response, operating the transmitter or transceiver 24 to transmit the wireless call signal. Other illustrative processes that the electronic processor 28 may be programmed to perform include polling the speakerphone console 30 to determine whether the PHB 10 is located in-residence, placing and handling a cellular telephone call, or so forth.

The electronic processor 28 is further programmed to perform a compliance monitoring process 42 using the fall detector 22 (or, more generally, using a motion sensor of the PHB) to assess compliance with wearing the wearable PHB 10. In illustrative embodiments, the compliance monitoring process 42 is designed to minimize power drain on the battery 20. In some illustrative embodiments (FIG. 2), the compliance monitoring process 42 performs compliance checks at successive compliance check times, e.g. every fifteen minutes as an illustrative example, with motion sensor data being acquired over a compliance data acquisition time interval that is shorter than the time interval between successive compliance check times, e.g. using a compliance data acquisition time interval that is one minute or less in some embodiments.

In other illustrative embodiments (FIG. 3), the compliance monitoring process 42 leverages a built-in energy saving mechanism of the accelerometer or other motion sensor to perform the compliance monitoring. For example, some accelerometers provide energy savings by way of a low-power mode, with a wake-up interrupt event being triggered when the accelerometer in low-power mode detects instigation of motion. In these illustrative embodiments, each detected wake-up interrupt event is logged in a wake-up event log, and a compliance report is generated using the wake-up event log. For example, the compliance report may comprise a histogram comprising time bins, in which each time bin stores a count of wake-up interrupt events occurring in a time interval corresponding to the time bin.

Figure 2:
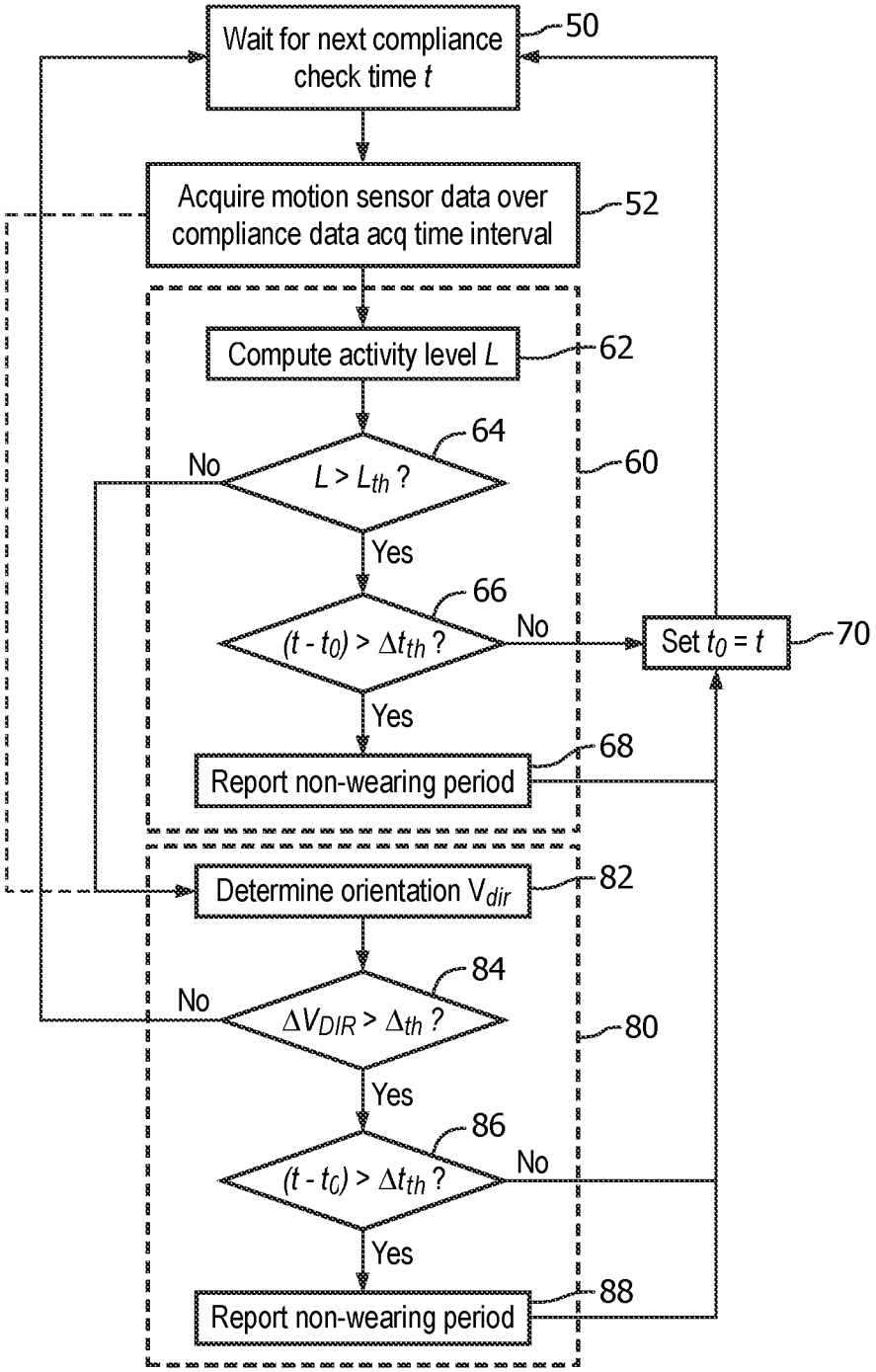
FIGS. 2 and 3 diagrammatically illustrate two suitable approaches for monitoring to detect non-compliance (that is, failure to wear the PHB).

With continuing reference to FIG. 1 and with further reference to FIG. 2, an illustrative embodiment of the compliance monitoring process 42 is described. A wait operation 50 waits for the next compliance check time t. The time interval between successive check times may be fifteen minutes, thirty minutes, an hour, or so forth. As will be described, it is also contemplated for the check time to be adjusted based on past compliance history or other factors. In an operation 52, when the check time arrives then the fall sensor 22 (or other motion sensor, e.g. an accelerometer or magnetometer) is used to acquire motion sensor data over a compliance data acquisition time interval. This acquisition time interval is preferably short to limit battery power consumption, for example being one minute or less in some embodiments, and 15-30 seconds in some embodiments. Using a short motion sensor data acquisition time interval reduced battery usage both during the acquisition and during post-acquisition data processing since a smaller motion sensor data set is less costly to process.

In general, compliance monitoring using processes such as those shown in FIG. 2 operate on the expectation that if the PHB 10 is being worn then the PHB 10 will move around over time; whereas, if the PHB 10 is not being worn then it is likely to be sitting motionless on a table or countertop, in a drawer, hanging on a coat rack, or so forth. In a straightforward approach, an activity level test 60 is performed. In this approach, an activity level L is computed from the acquired motion sensor data set in an operation 62. The activity level L can be the maximum magnitude of the accelerometer (or other motion sensor) signal, its variance, the sum of the absolute values over the three spatial axes, or so forth. One illustrative approach for computing activity level L is to compute the product of the accelerometer value of the three spatial axes, per sample in the data set. Next, the variance of these product values is computed. Since the range of possible values is large, the logarithm can be taken, creating decibel (dB) values. Since this is a monotonic operation and the outcome is tested to pass a threshold, it can be omitted to save computational load. In an operation 64, the activity level L is compared against a threshold activity level $L_{th}$, and it is determined that the PHB 10 is (gently) moving if the activity level L exceeds the threshold activity level $L_{th}$, i.e. the PHB 10 is currently being worn if $L>L_{th}$. A typical activity level threshold $L_{th}$ is zero or plus or minus a few dB, since if the PHB 10 is sitting on a tabletop or the like it is expected to be motion-free. The activity level threshold may be set as follows. The level measured when lying still is determined, and the threshold is set to be close to, but above, that level. The minimum (motion-free) level is determined by the noise level of the accelerometer. If the activity level L is above the threshold $L_{th}$, it is concluded the PHB 10 is being worn by the subscriber (at that instant in time). With the knowledge that the PHB 10 is now being worn, in an operation 66 it is determined whether the time since last positive indication of the PHB 10 being worn is greater than a threshold value for reporting a non-compliance event. To this end, the last check time that yielded a positive indication of the PHB 10 being worn is stored as a time $t_0$ (or, alternatively, this reference time may be the initial check time that non-wearing was detected), and therefore the time since last positive indication of the PHB 10 being worn (or, since the non-wearing was initially detected) is given by $(t-t_0)$ where again t denotes the current check time. The test 66 for non-compliance can thus be written as $(t-t_0)>\Delta t_{th}$ where $\Delta t_{th}$ is the threshold time for reporting a non-compliance event, i.e. reporting a non-wearing period in operation 68. Regardless of the outcome of the non-compliance test 66, if the test 64 for the current check time t has yielded a positive indication that the PHB 10 is now being worn, then in an operation 70 the last check time $t_0$ that yielded a positive indication of the PHB 10 being worn is set to t, i.e. $t_0 \leftarrow t$ for use as the reference in the next check time.

The activity level test 60 for compliance has a low false positive rate, since if the PHB 10 is sitting motionless on a table or the like then it is unlikely that the activity level L generated in operations 52, 62 will exceed the activity level threshold $L_{th}$. However, the false negative rate of the activity level test 60 is expected to be high, since if the subscriber is wearing the PHB 10 but remains motionless during the compliance data acquisition time interval over which the data acquisition 52 is performed then the activity level test 60 will not detect that the subscriber is wearing the PHB 10. Because the compliance data acquisition time interval is preferably chosen to be short, e.g. one minute or less in some embodiments, the likelihood of a false negative is high.

With continuing reference to FIG. 2, to address the expected high false negative rate of the activity level test 60, if the activity level test 60 yields a negative result (subscriber not detected as wearing the PHB 10) then a second test, namely an orientation change test 80, is performed on the same data set acquired in the operation 52. This test relies on the expectation that there is a high likelihood that the orientation in space of the PHB 10 will change between successive check times, even if the subscriber is motionless at the time of the data acquisition. The orientation change test 80 can be performed when using a motion sensor such as an accelerometer or a magnetometer that provides a signal indicative of orientation of the sensor (and hence indicative of orientation of the PHB 10). For example, the signal output by a motionless accelerometer is due to the gravitational acceleration; this signal is highest for a single-axis accelerometer when it is aligned with the gravitational vector and is zero when oriented transverse to the gravitational vector. Similarly, the signal output by a magnetometer in the absence of external magnetic fields is due to the Earth's magnetic field; this signal is highest for a single-axis magnetometer when it is aligned with the Earth's magnetic field and is zero when oriented transverse to the Earth's magnetic field. If a three-axis accelerometer or three-axis magnetometer is used as the motion sensor, then the vector combination of the outputs of the three axes provides more unambiguous information about the orientation. In another illustrative embodiment, the motion sensor is a combination of an accelerometer and a magnetometer, which can provide improved sensitivity over either device alone as motion respective to both gravity and Earth's magnetic field is detectable.

The illustrative orientation change test 80 operates as follows. In an operation 82 the current orientation $v_{Dir}$ is determined. In a suitable embodiment employing a three-axis accelerometer as the motion sensor, $v_{Dir}$ is the direction of gravity measured by the data set acquired in the operation 52, for example computed by taking the average of the acceleration data over one second. To reduce processing time, the window for computing the gravitational direction can be smaller than the entire data set since the negative result for the activity level test 60 indicates that there is little or no movement over the compliance data acquisition time interval (although noise can be reduced by averaging over the window, so the window size may be chosen to balance noise reduction versus processing time). In the case of a three-axis magnetometer, $v_{Dir}$ is suitably the magnetic field direction or an equivalent representation (e.g., composed of individual vector components from which direction can be derived). The measured direction $v_{Dir}$ is optionally normalized to a unit size vector, but in case there is no change in orientation this is just a scaling operation which can be omitted to reduce the number of computations. In an operation 84, the obtained orientation is compared with the orientation obtained in the previous check time to generate a measured orientation change $\Delta v_{Dir}$, which is then compared against a threshold change $\Delta_{th}$ A suitable approach is to compute the dot product of the (normalized) directions and subtracting that from 1, i.e. $\Delta v_{Dir}=1-v_{Dir}(t)\cdot v_{Dir}(t-1)$ where $v_{Dir}(t)$ is the orientation obtained for the current check time t in the operation 82 and $v_{Dir}(t-1)$ is the orientation obtained for the last check time in the operation 82. (Alternatively, if normalization is not performed then the difference number (1) is scaled according to the vector length). A positive indication that the subscriber is wearing the PHB 10 is then obtained if $\Delta v_{Dir}>\Delta_{th}$. As with the activity level the dB value could be taken to bring values in scale and range, but for the actual algorithm this is not needed and the omission will reduce computational load. Another contemplated variant to improve computational efficiency is that the subtraction from 1 (or scaled value if normalization is omitted) can be incorporated by adapting the threshold and testing for being below instead of above that adapted threshold). If the test 84 is passed, then it is known that the PHB 10 is now being worn (or, at least, has been worn at some time between the current and last check times). Accordingly, in an operation 86 paralleling operation 66 it is determined whether the time since last positive indication of the PHB 10 being worn is greater than the threshold time $\Delta t_{th}$ for reporting a non-compliance event, and if so then a non-wearing period is reported in operation 88 which is analogous to operation 68. (Thus, in the programmed implementation the operations 86, 88 and the operations 66, 68 can be combined as a single processing flow that is entered via an affirmative, i.e. "yes" result from either decision 64, 84). Regardless of the outcome of the non-compliance test 86, if the test 84 for the current check time t has yielded a positive indication that the PHB 10 is now being worn, then the operation 70 is also performed to set $t_0 \leftarrow t$ for use as the reference in the next check time.

Although not illustrated, if a non-wearing period is reported (operation 68 or operation 88) then the time interval between successive check times can optionally be shortened so that a better granularity of non-wearing period detections can be achieved. For example, to detect whether the user takes off the PHB 10 during bathing or showering, a shorter sampling period might be beneficial. The time interval between successive check times can also optionally be adjusted for different times of the day (e.g. different intervals for day versus night) or for different days of the week or so forth. As another variant, a check time may be skipped if the state of the PHB 10 otherwise indicates that the subscriber is wearing the PHB 10. For example, a check may be skipped if the subscriber has recently pressed the call button 12 since this already indicates the PHB 10 is being worn.

The reporting 68, 88 of a non-wearing period can take various forms. In one approach, such periods are logged at the PHB 10 and reported to the PERS center 8, where suitable follow-up can be performed. Additionally or alternatively, the report can include providing the subscriber with a reminder that he or she should be wearing the PHB 10. For example, the transmitter or transceiver 24 may generate a non-compliance indicator signal (different from the call signal generated by pressing the call button 12) that is detected by the speakerphone console 30. In response to detecting the non-compliance indicator signal, the speakerphone console 30 outputs via speaker 34 an audible reminder to wear the wearable personal help button. For example, the audible reminder may be playing a pre-recorded message stating "Please put your personal help button on."

In the compliance monitoring process of FIG. 2, it will be noted that the testing for a non-compliance period greater than the threshold $\Delta t_{th}$ is performed in the operations 66, 86 which execute only after a positive indication has been detected that the PHB 10 is currently being worn. In other words, the non-compliance is not reported until the next detected incidence of compliance. This approach cannot detect indefinite non-compliance, for example due to incapacitation of the subscriber. In a variant embodiment (not shown), a test for extended non-compliance is performed for each check time. For example, extended non-compliance can be detected if $(t-t_0)>\Delta t_{th,ext}$ where the extended threshold $\Delta t_{th,ext}>\Delta t_{th}$ is the threshold time interval beyond which an extended non-wearing period is reported. This report may, for example, be processed under the PERS protocol by triggering the summoning a caregiver to physically check in on the subscriber.

The illustrative approach of FIG. 2 employs both wearing motion and orientation compliance tests 60, 80. In other contemplated embodiments, the activity level test 60 for wearing compliance is omitted, and wearing compliance is only tested based on orientation, i.e. by the orientation change test 80.

Figure 3:
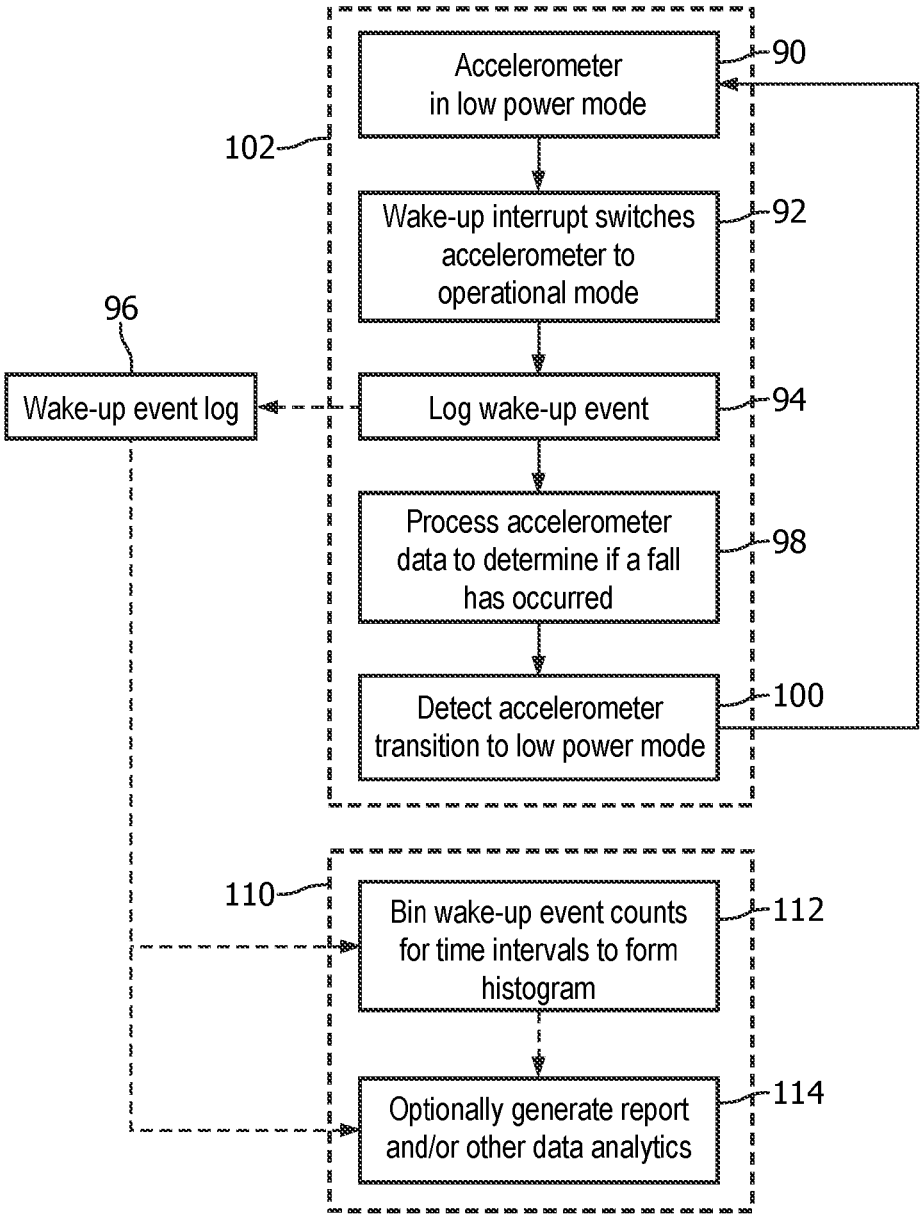

With reference back to FIG. 1 and with further reference to FIG. 3, another illustrative embodiment of the compliance monitoring process 42 is described. This embodiment operates in conjunction with an accelerometer or other motion sensor (e.g., a magnetometer or combined accelerometer/magnetometer) that provides energy savings by way of a low-power mode 90, with a wake-up interrupt event 92 being triggered when the accelerometer (or magnetometer or other motion sensor) in low-power mode detects instigation of motion. In an operation 94, the wake-up interrupt event is detected by the electronic processor 28 and logged in a wake-up event log 96. The accelerometer now operating in its normal operational mode is used by the fall detection process 40 executing on the electronic processor 28 (see FIG. 1) to perform an operation 98 which processes accelerometer data to determine whether the subscriber has fallen. In an operation 100, the electronic processor 28 detects that the accelerometer has transitioned back to the low power mode and resumes waiting to detect the next wake-up interrupt event.

The foregoing logging operations 102 are performed by the electronic processor 28 of the PHB 10, and operate to generate the wake-up event log 96 which can be analyzed by a reporting process 110 to generate a report on subscriber compliance. In illustrative FIG. 3, this entails generating a histogram in an operation 112, which includes bins corresponding to time intervals with each histogram bin storing a count of the number of wake-up events that occurred in the corresponding time interval. This histogram may be used in an operation 114 to generate a compliance report or to perform other data analytics. For example, the histogram may be analyzed to determine the largest number of wake-up events $N_{max}$ occurring in any given time interval. Then, any time interval for which the number of wake-up events is smaller than some threshold, e.g. $0.1N_{max}$, is identified as a non-wearing period. Such an analysis can optionally be performed for designated time periods, e.g. different $N_{max}$ values may be computed for daytime versus nighttime to account for the expected fewer number of wake-up interrupt events at night when the subscriber is most likely to be sleeping as compared with daytime when the subscriber is more likely to be active for at least some time interval bins. In another approach, comparisons are made between different days: for example, a much lower wake-up interrupt event count for a time interval bin for one day compared with counts for the same time interval bin on most other days provides a strong indication that the lower-count time interval bin of the one day is a non-wearing period. Because the reporting process 110 is computationally intensive, it is preferably not performed by the electronic processor 28 of the PHB 10. Rather, the wake-up event log 96 may be offloaded to the PERS center 8 via the transceiver 24 and speakerphone console 30 or another suitable connection (e.g. the cellular transceiver 26 and the reporting process 110 performed by a computer at the PERS center 8.

In the disclosed embodiments, the compliance monitoring process 42 (with the exception of the reporting process 110 in FIG. 3) is performed by the electronic processor 28 of the PHB 10. However, it is contemplated for some of this processing to be performed by another electronic processor such as a computer at the PERS center 8. For example, in the embodiment of FIG. 2 the data acquisition operation 52 may be performed by the electronic processor 28 of the PHB 10, and then the resulting data stored at the PHB 10 and sent to the PERS center 10 when, for example, the PHB 10 is docked at a battery recharging port. The remaining operations of the compliance monitoring process of FIG. 2 are then suitably performed on the transferred data set by a computer at the PERS center 10.

The illustrative embodiments are directed to compliance regarding the wearing of the PHB 10 used to provide PERS service. It will be appreciated, however, that the disclosed approaches can be employed for monitoring compliance in wearing other types of wearable health devices such as activity monitors, vital sign monitors, or so forth.

The invention has been described with reference to the preferred embodiments. Modifications and alterations may occur to others upon reading and understanding the preceding detailed description. It is intended that the invention be construed as including all such modifications and alterations insofar as they come within the scope of the appended claims or the equivalents thereof.

The invention claimed is:

1. A device for use in conjunction with a personal emergency response system (PERS), the device comprising:

a wearable personal help button including a call button, a motion sensor, and a transmitter or transceiver configured to transmit a wireless call signal in response to the call button being pressed; and an electronic processor programmed to perform a compliance monitoring process using the motion sensor to assess compliance with wearing the wearable personal help button wherein the compliance monitoring process is performed at successive compliance check times and includes, at each compliance check time:

acquiring motion sensor data from the motion sensor of the wearable personal help button over a compliance data acquisition time interval shorter than the time interval between successive compliance check times;

determining from the motion sensor data acquired over the compliance data acquisition time interval whether the wearable personal help button has moved since the last compliance check time by:

determining a current orientation ($v_{Dir}$) of the wearable personal help button from the motion sensor data acquired over the compliance data acquisition time interval; and determining the wearable personal help button has moved since the last compliance check time if a difference ($\Delta v_{Dir}$) between the current orientation of the wearable personal help button and the orientation of the wearable personal help button determined for the last compliance check time exceeds a threshold difference ($\Delta_{th}$); and assessing compliance with wearing the wearable personal help button based at least in part on the determination of whether the wearable personal help button has moved since the last compliance check time.

2. The device of claim 1 wherein the determining comprises:

determining an activity level (L) of the wearable personal help button from the motion sensor data acquired over the compliance data acquisition time interval; and determining the wearable personal help button has moved since the last compliance check time if the activity level exceeds a threshold activity level ($L_{th}$).

3. The device of claim 1 wherein:

the compliance data acquisition time interval is one minute or less, and the time interval between successive compliance check times is 15 minutes or more, and the electronic processor determines whether the wearable personal help button has moved since the last compliance check time based only on motion sensor data acquired during over the compliance data acquisition time intervals of the current compliance check time and the last compliance check time.

4. The device of claim 1 wherein the motion sensor comprises at least one of an accelerometer and a magnetometer.

5. The device of claim 1 further comprising:

a speakerphone console including a speaker and a microphone, the speakerphone console configured to detect the wireless call signal transmitted by the transmitter or transceiver of the wearable personal help button and to establish a telephone call in response to detecting the wireless call signal.

6. The device of claim 5 wherein the speakerphone console is configured to output an audible reminder to wear the wearable personal help button via the speaker if the compliance monitoring process assesses non-compliance with wearing the wearable personal help button.

7. A device for use in conjunction with a personal emergency response system (PERS), the device comprising:

a wearable personal help button including a call button, a motion sensor, and a transmitter or transceiver configured to transmit a wireless call signal in response to the call button being pressed; and an electronic processor programmed to perform a compliance monitoring process using the motion sensor to assess compliance with wearing the wearable personal help button, wherein the compliance monitoring process includes:

detecting a wake-up interrupt event that causes the motion sensor to switch from a low-power mode to an operational mode;

logging each detected wake-up interrupt event in a wake-up event log; and generating a compliance report assessing compliance with wearing the wearable personal help button using the wake-up event log.

8. The device of claim 7 wherein generating the compliance report includes:

generating a wake-up interrupt event histogram comprising time bins wherein each time bin stores a count of wake-up interrupt events occurring in a time interval corresponding to the time bin.

9. A wearable health device comprising:

a health monitoring component configured to acquire physiological data, acquire activity data, or generate a medical call signal;

a motion sensor; and an electronic processor programmed to perform a compliance monitoring process using the motion sensor to assess compliance with wearing the wearable health device wherein the compliance monitoring process is performed at successive compliance check times and includes, at each compliance check time:

acquiring motion sensor data from the motion sensor of the wearable health device over a compliance data acquisition time interval shorter than the time interval between successive compliance check times;

determining from the motion sensor data acquired over the compliance data acquisition time interval whether the wearable health device has moved since the last compliance check time by:

determining a current orientation ($v_{Dir}$) of the wearable health device from the motion sensor data acquired over the compliance data acquisition time interval; and determining the wearable health device has moved since the last compliance check time if a difference ($\Delta v_{Dir}$) between the current orientation of the wearable health device and the orientation of the wearable health device determined for the last compliance check time exceeds a threshold difference ($\Delta_{th}$); and assessing compliance with wearing the wearable health device based at least in part on the determination of whether the wearable health device has moved since the last compliance check time.

10. The wearable health device of claim 9 wherein the determining comprises:

determining an activity level (L) of the wearable health device from the motion sensor data acquired over the compliance data acquisition time interval; and determining the wearable health device has moved since the last compliance check time if the activity level exceeds a threshold activity level ($L_{th}$).

11. A method performed in conjunction with a personal emergency response system (PERS), the method comprising:

transmitting a wireless call signal in response to the pressing of a call button of a wearable personal help button;

detecting the wireless call signal at a speakerphone console and establishing a telephone call via the speakerphone console in response to detecting the wireless call signal; and performing a compliance monitoring process using a motion sensor of the wearable personal help button to assess compliance with wearing the wearable personal help button, the compliance monitoring process including, at each compliance check time of a succession of compliance check times:

acquiring motion sensor data from the motion sensor of the wearable personal help button over a compliance data acquisition time interval shorter than the time interval between successive compliance check times;

determining from the motion sensor data acquired over the compliance data acquisition time interval whether the wearable personal help button has moved since the last compliance check time by:

determining a current orientation ($v_{Dir}$) of the wearable personal help button from the motion sensor data acquired over the compliance data acquisition time interval; and determining the wearable personal help button has moved since the last compliance check time if a difference ($\Delta v_{Dir}$) between the current orientation of the wearable personal help button and the orientation of the wearable personal help button determined for the last compliance check time exceeds a threshold difference ($\Delta_{th}$); and assessing compliance with wearing the wearable personal help button based at least in part on the determination of whether the wearable personal help button has moved since the last compliance check time.

12. The method of claim 11 wherein the determining further comprises:

determining an activity level (L) of the wearable personal help button from the motion sensor data acquired over the compliance data acquisition time interval; and determining the wearable personal help button has moved since the last compliance check time if the activity level exceeds a threshold activity level ($L_{th}$).

* * * * *